US012698907B2

(12) United States Patent
Remeeus

(10) Patent No.: US 12,698,907 B2
(45) Date of Patent: Aug. 4, 2026

(54) OVEN INSERT

(71) Applicant: B/E Aerospace, Inc., Winston Salem, NC (US)

(72) Inventor: Richard Remeeus, Eindhoven (NL)

(73) Assignee: B/E AEROSPACE, INC., Winston Salem, NC (US)

( * ) Notice: Subject to any disclaimer, the term of this patent is extended or adjusted under 35 U.S.C. 154(b) by 410 days.

(21) Appl. No.: 18/467,641

(22) Filed: Sep. 14, 2023

(65) Prior Publication Data

US 2024/0167699 A1 May 23, 2024

(30) Foreign Application Priority Data

Nov. 17, 2022 (EP) ..... 22208184

(51) Int. Cl.
*F24C 15/32* (2006.01)
*F24C 15/00* (2006.01)
*F24C 15/16* (2006.01)

(52) U.S. Cl.
CPC ..... *F24C 15/322* (2013.01); *F24C 15/007* (2013.01); *F24C 15/16* (2013.01)

(58) Field of Classification Search
CPC ..... A21B 3/02; A21B 1/245; F24F 13/1413; F24C 15/322; F24C 15/325
See application file for complete search history.

(56) References Cited

U.S. PATENT DOCUMENTS

| | | | | |
|---|---|---|---|---|
| 2003/0213718 | A1 | 11/2003 | Ducharme et al. | |
| 2011/0083657 | A1* | 4/2011 | Ploof | F24C 15/322 126/21 A |
| 2020/0288725 | A1 | 9/2020 | ten Dam | |
| 2021/0221513 | A1 | 7/2021 | ten Dam et al. | |
| 2021/0251422 | A1 | 8/2021 | Swayne et al. | |
| 2022/0313017 | A1* | 10/2022 | Garcia | A47J 37/0664 |

FOREIGN PATENT DOCUMENTS

| | | | |
|---|---|---|---|
| CN | 110338631 | 10/2019 | |
| CN | 216932830 | 7/2022 | |
| DE | 3508747 | 9/1985 | |
| DE | 29907113 | 7/1999 | |
| EP | 1344986 A1 * | 9/2003 | F24C 15/322 |
| WO | 1986001077 | 2/1986 | |

OTHER PUBLICATIONS

Machine generated translation of DE-102021116718-A1 by Clarivate (Year: 2022).*
EPO, Extended European Search Report dated Apr. 13, 2023 in EP Serial No. 22208184.6.

* cited by examiner

*Primary Examiner* — Ngoc T Nguyen
(74) *Attorney, Agent, or Firm* — SNELL & WILMER L.L.P.

(57) ABSTRACT

An insert for an oven including a housing and a food cooking volume inside the housing. A plurality of deflectors are movably mounted on the housing. The plurality of deflectors are configured to be actuated from a first position to a second position. The plurality of deflectors are configured to deflect air towards the food cooking volume when the plurality of deflectors are in the second position during operation of the oven.

13 Claims, 6 Drawing Sheets

OVEN INSERT

CROSS-REFERENCE TO RELATED APPLICATIONS

This application claims priority to, and the benefit of, EP Patent Application No. 22208184.6, filed Nov. 17, 2022 and titled "OVEN INSERT," which is incorporated by reference herein in its entirety for all purposes.

FIELD

This disclosure relates to an insert for an oven. In particular, the disclosure relates to an insert which deflects air inside an oven.

BACKGROUND

For certain types of foods, it is desirable to be able to produce a crispy outer surface during the cooking process. Furthermore, it is often desirable for the cooking time to be as short as possible. However, these objectives may be difficult to achieve in certain ovens. This may be due to a low maximum temperature or slow airflow around the oven. This may be a particular problem in ovens used on board aircraft, as their maximum temperature is limited due to safety regulations.

Typically, in order to reduce cooking times and produce crispy food, oil is used during the cooking process. For example, the surface of the food may be coated in oil. However, it is known that consuming too much fat can have a harmful effect on a person's health. The present disclosure aims to address some of these problems by providing an insert for an oven.

SUMMARY

According to the present disclosure, there is provided an insert for an oven, comprising:

a housing;

a food cooking volume inside the housing;

a plurality of deflectors movably mounted on the housing;

wherein the plurality of deflectors are configured to be actuated from a first position to a second position; and wherein the plurality of deflectors are configured to deflect air towards the food cooking volume when the plurality of deflectors are in the second position during operation of the oven.

The oven may be any suitable and desired type. In some examples, the oven may be an electrical oven. In some examples, the oven may be a fan-assisted oven, comprising a fan and a heating element (e.g. a convection oven). In some examples, the oven may be a steam oven, which additionally comprises a source of water which is heated by the heating element. In some examples, the heating element may be an electrical heating element.

In some examples, the oven is suitable for use on an aircraft. For example, it may be compliant with certain safety standards (e.g. by having a limited maximum power and/or temperature). It may be of a suitable shape and size to fit inside the galley, in particular inside a standard galley compartment. In some examples, the oven may be suitable for cooking many meals at one time, for example more than 10 meals, optionally more than 20 meals, optionally more than 30 meals, optionally more than 40 meals.

The insert may also be known as a meal carrier. In some examples, a plurality of inserts may be used inside an oven.

For example, the inserts may be stacked on top of one another inside the oven. This may be advantageous if food is being prepared or served in stages (for example, in an airplane where food is served in stages throughout the cabin), or if different types of food are being cooked which require different cooking times (although they may also be cooked inside the same insert in this case).

The housing may be any suitable and desired shape and size. The housing will be configured to fit inside the oven while the oven and insert are in use (i.e. when the deflectors are in the second position and the oven is closed).

The housing may have closed or open sides, or a combination of both. For example, the housing may comprise a frame, e.g. with one, more or all sides being open. In other examples, the housing may comprise walls such that one or more of the sides are closed. In all these cases, the housing should allow sufficient airflow into and around the housing such that the deflectors can deflect air into the food cooking volume.

The food cooking volume is defined as the volume inside the housing. Cooking comprises heating the food. In some examples, the food may be entirely cooked by the oven (i.e. go from a raw state to a cooked state). In some examples, the food may be at least partially cooked before being placed inside the food cooking volume, such that the oven only heats and/or crisps the food. Food may be placed anywhere inside the food cooking volume in order to be cooked. In some examples, not all of the food cooking volume is used. In some examples, the deflectors may extend at least partially into the food cooking volume.

The plurality of deflectors may be mounted on the housing in any suitable and desired way. In some examples, the deflectors are rotatably mounted on the housing (e.g. by an axle). In some examples, the deflectors are arranged to fold out from the housing (e.g. by a hinge). In some examples, the deflectors are arranged to extend telescopically.

The deflectors are configured to be actuated from a first position to a second position. The deflectors are in the first position at least when the insert is out of use (e.g. it is outside of the oven). This position may help to facilitate insertion of the insert into the oven, e.g. because the deflectors may not extend as far outside the insert in the first position. The deflectors are in the second position when the insert is in use (e.g. during operation of the oven). In some examples, the deflectors may be arranged to rotate by approximately 90 degrees between the first and the second position.

In some examples, the insert for an oven comprises at least one receptacle for holding food, wherein the at least one receptacle for holding food is removably mounted in the housing. The at least one receptacle may be any suitable and desired type. The receptacle comprises at least one surface for holding food (e.g. a substantially horizontal bottom surface). In some examples, the surfaces for holding food may comprise: features such as indentations for placing food into; sections for separating food; and/or features to optimize different cooking results (e.g. holes and/or ribs). The receptacle may be any suitable and desired shape and size. In some examples, the receptacle may be large enough to hold a plurality of meals at one time.

The at least one receptacle may be removably mounted in the housing in any suitable and desired manner. In some examples, the receptacle is slidably mounted in the housing (e.g. by resting on a rack inside the insert, or being mounted on rails). This may facilitate easy removal of the receptacle, for example for cleaning the receptacle or placing food inside the receptacle.

In some examples, the at least one receptacle for holding food comprises a plurality of apertures. The plurality of apertures may help air to circulate around the food cooking volume. In some examples, the at least one receptacle comprises a substantially meshed structure, and the plurality of apertures are defined by the holes in the mesh.

In some examples, the housing comprises a front face and a rear face opposite the front face, wherein the at least one receptacle for holding food comprises a rear side arranged to be proximal to the rear face of the insert and the at least one receptacle for holding food comprises a substantially closed surface at the rear side. The rear face of the insert is arranged to be proximal to the rear face of the oven when the insert is inserted into the oven, wherein the rear face of the oven comprises a fan and a heating element. The front face of the insert is arranged to be proximal to the front face of the oven when the insert is inserted into the oven.

The substantially closed surface may be formed of any suitable and desired material (e.g. metal or plastic). The substantially closed surface may be configured to deflect air. This may help to focus the airflow inside the food cooking volume (i.e. proximal to the food held inside the receptacle).

In some examples, the substantially closed surface may be inclined with respect to the front face of the receptacle. In some examples, the substantially closed surface may be inclined towards the front face of the receptacle. This may help to deflect air towards the food held inside the receptacle, which may help to decrease the cooking time.

In some examples, the at least one receptacle for holding food comprises a plurality of surfaces for holding food. In some examples, the surfaces for holding food are substantially parallel and spaced apart vertically in the receptacle. The number of surfaces used may depends on the shape and size of the receptacle, and the type of food being cooked. For example, when smaller items of food are being cooked, the receptacle may comprise more surfaces due to the smaller volume required for each item of food.

In some examples, the housing comprises a front face and a rear face opposite the front face, wherein the at least one receptacle for holding food comprises a rear side arranged to be proximal to the rear face of the insert, and a front side opposite the rear side and wherein the at least one receptacle for holding food comprises a substantially vertical divider that extends in a direction between the front side and the rear side of the receptacle.

In some examples, the divider comprises a substantially closed surface configured to deflect air. This may help to reduce turbulence inside the food cooking volume, by separating streams of air travelling in opposing directions inside the food cooking volume. In some examples, the divider may be substantially perpendicular to at least one of the front side and/or the rear side of the receptacle. In some examples, the divider may bisect at least one of the front and/or the rear side of the receptacle.

In some examples, the insert for an oven comprises at least one receptacle for holding oil. The receptacle for holding oil may be any suitable and desired type. In some examples, the receptacle for holding oil comprises a dish placed on a surface of the insert (e.g. inside a receptacle for holding food). In some examples, the receptacle for holding oil comprises a tube which may be mounted in the insert (e.g. on the housing or on the receptacle for holding food).

In some examples, the at least one receptacle for holding oil is perforated. This may help oil to leave the receptacle during the cooking process. In some examples, the oil is moved out of the receptacle by the air circulating inside the oven during operation of the oven. The oil may then be carried around the oven by the air, and come into contact with a surface of the food being cooked. Therefore, the food may be at least partially coated in the oil. This may help to achieve crispy results and reduce the cooking time required compared to not using oil in the cooking process. Furthermore, this may help to achieve certain aesthetic qualities of the cooked food (e.g. browning of the surface of the food). However, this process may help to reduce the amount of oil used compared to applying the oil directly to the food.

In some examples, the insert for an oven comprises at least one drip tray, wherein the at least one drip tray is mounted in the housing below the at least one receptacle for holding food. The drip tray may be any suitable and desired type. The drip tray may comprise a substantially flat surface. The drip tray may be mounted substantially horizontally inside the housing.

In some examples, the drip tray may be removably mounted in the housing. This may help to facilitate cleaning of the drip tray. The drip tray may be mounted inside the housing in any suitable and desired manner. In some examples, the receptacle is slidably mounted in the housing (e.g. by resting on a rack inside the insert, or being mounted on rails).

In some examples, the drip tray may have substantially the same extent in a substantially horizontal plane as the receptacle for holding food. This may help to ensure that the drip tray is able to catch any oil or crumbs that falls from anywhere within the receptacle.

In some examples, the insert may comprise a drip tray underneath each of the receptacles. This may help to reduce cross-contamination between food in each of the receptacles, which may be advantageous if different types of food are being cooked inside each receptacle.

In some examples, the plurality of deflectors are rotatably mounted on the housing. In some examples, the plurality of deflectors are mounted on the housing by an axle, which allows the deflectors to rotate about an axis of the axle.

In some examples, each deflector is individually mounted on the housing. In some examples, the deflectors are connected together such that not all of the deflectors are directly mounted to the housing (e.g. some deflectors may be mounted to the housing via another deflector).

In some examples, the plurality of deflectors are configured to be mechanically actuated from the first position to the second position. The deflectors may be mechanically actuated in any suitable and desired way. In some examples, each deflector is actuated individually (e.g. by separate mechanisms). However, in some examples, at least some of the deflectors are connected together (e.g. by a rod) and they are actuated together (e.g. by the same mechanism).

In some examples, the plurality of deflectors are configured to be actuated when a door of the oven closes. In some examples, the oven door may be configured to interact with a component of the insert to actuate the deflectors. For example, the oven door may press against at least one of the deflectors when it is closed, such that the at least one deflector moves from the first position to the second position. In some examples, at least some of the deflectors may be coupled (e.g. by a rod) such that when at least one of the deflectors is actuated by the oven door, the other coupled deflectors are also actuated. In some such examples, the oven door may press against the coupling component (e.g. rod) to actuate the deflectors.

In some examples, the plurality of deflectors are configured to be actuated when the insert is inserted into the oven. In some examples, the insert may comprise a component (e.g. a latch or catch) which extends from a rear face of the insert. When the insert is inserted into the oven, this component may press against the rear face of the oven to actuate the deflectors (e.g. by applying a force to rotate at least one deflector), wherein the rear face of the oven comprises a fan and a heating element. In some examples, at least some of the deflectors may be coupled (e.g. by a rod) such that when at least one of the deflectors is actuated by the insert being inserted into the oven, the other coupled deflectors are also actuated. In some examples, the component may press against the coupling component (e.g. rod), causing the coupling component to move and actuate the deflectors.

In some examples, the plurality of deflectors are configured to be actuated when the at least one receptacle for holding food is mounted in the insert and the insert is inside the oven. In some examples, the at least one receptacle may rest on another component of the insert (e.g. a shelf or mount), which moves in response to the weight of the receptacle. This component may press against at least one deflector to move it from the first to the second position. In some examples, at least some of the deflectors may be coupled (e.g. by a rod) such that when at least one of the deflectors is actuated by the at least one receptacle, the other coupled deflectors are also actuated. In some examples, the component may press against the coupling component (e.g. rod), causing the coupling component to move and actuate the deflectors.

In some examples, the insert comprises a rod, wherein the plurality of deflectors are connected to the rod and the plurality of deflectors are configured to be actuated by the rod when:

a door of the oven closes; or the insert is inserted into the oven; or the at least one receptacle for holding food is mounted in the insert and the insert is inside the oven.

In some examples, the rod may comprise a spring-loaded rod. The (e.g. spring(s) of the) spring-loaded rod(s) may be biased such that the deflectors are moved back to the first position, e.g. when the selected condition no longer exists (e.g. when the oven door is opened again).

The (e.g. spring-loaded) rod may be connected to all of the deflectors of an insert, or only some (e.g. one or more) of them. An insert may comprise a plurality of (e.g. spring-loaded) rods (e.g. two spring-loaded rods), each (e.g. spring-loaded) rod connected to one, more or all of the plurality of deflectors.

The (e.g. spring-loaded) rod(s) may be configured to facilitate actuation of the deflectors using any of the methods described herein. For example, if the deflectors are to be actuated when a door of the oven closes, the (e.g. spring-loaded) rod(s) may be substantially horizontal and extend towards the front face of the oven, such that the door of the oven presses on an end of the (e.g. spring-loaded) rod(s) when the door of is closed.

In some examples, the plurality of deflectors are configured to be actuated by air circulating inside the oven during operation of the oven. In some examples, at least one of the deflectors is configured such that it is moved from the first position to the second position by the force exerted on it by air circulating inside the oven. In some examples, at least one of the deflectors may be shaped such that it catches air. In some examples, at least some of the deflectors may be coupled (e.g. by a rod) such that when at least one of the deflectors is actuated by the air, the other coupled deflectors are also actuated.

In some examples, the plurality of deflectors are configured to be electrically actuated from the first position to the second position. The deflectors may be electrically actuated in any suitable and desired way. Each deflector may be individually actuated (e.g. by an independent control signal sent when the contact is activated), or at least some of the deflectors may be actuated together (e.g. by a shared control signal or by a mechanical connection).

In some examples, the insert comprises an electrical contact, wherein the plurality of deflectors are connected to the electrical contact and the plurality of deflectors are configured to be actuated by the electrical contact when:

a door of the oven closes; or the insert is inserted into the oven; or the oven is switched on; or the at least one receptacle for holding food is mounted in the insert and the insert is inside the oven.

The electrical contact may be configured to facilitate actuation of the deflectors when any of the above conditions exist. The electrical contact may be positioned anywhere on the insert. For example, if the plurality of deflectors are configured to be actuated by the electrical contact when the oven door closes, the electrical contact may be placed on a front face of the insert, such that the oven door presses against the electrical contact when the oven door closes. In some examples, a plurality of electrical contacts may be used (e.g. at different locations on the insert).

In some examples, at least some of the deflectors may be coupled (e.g. by a rod) such that when at least one of the deflectors is actuated by the electrical contact, the other coupled deflectors are also actuated.

In some examples, the plurality of deflectors are rotatably mounted on the housing and the plurality of deflectors each have curved cross-section in a plane perpendicular to the deflector's axis of rotation. The curve may be any suitable and desired shape. The curved cross-section may be configured to help deflect air into the food cooking volume. In some examples, the curved cross-section may be an arc of a circle.

In some examples, the housing comprises two side faces and at least one deflector is movably mounted on each of the side faces of the housing. The side faces of the housing may be substantially perpendicular to the front and back faces of the housing. Providing at least one deflector on each side of the housing may help to ensure that air is moved into the food cooking volume from both sides of the oven, which may help to achieve even cooking throughout the food cooking volume by making the speed and volume of the air flow more uniform throughout the food cooking volume.

In some examples, the housing comprises at least one side face, an opening in a front face of the housing, and a rear face opposite the front face wherein a plurality of deflectors are movably mounted on the at least one side face of the housing and the plurality of deflectors are spaced apart from each other along a direction from the rear face of the housing to the front face of the housing. This may help to ensure that air is moved into the entire cooking volume. In some examples, the plurality of deflectors are equally spaced from one another along the side of the housing. In some examples, the plurality of deflectors are mounted on two side faces of the housing. In some examples, the spacing between deflectors may be the same on each of the two faces of the housing, such that each deflector has a corresponding deflector on the opposite side face of the housing.

In some examples, the housing comprises an opening in a front face of the housing, and a rear face opposite the front face;

wherein the plurality of deflectors are rotatably mounted on the housing;

wherein the plurality of deflectors each have curved cross-section in a plane perpendicular to the deflector's axis of rotation, defining a radius of curvature; and wherein the radius of curvature of each of the plurality of deflectors is proportional to the distance between the front face of the housing and the axis of rotation of the deflector. Therefore, deflectors closer to the front face of the housing have a smaller radius of curvature than deflectors further away from the front face of the housing. The relationship (i.e. proportionality) between the distance and the radius of the curvature may be determined according to the requirements of the system.

As the air travels from the back to the front of the oven, it may be desirable that a greater proportion of the air is deflected into the food cooking volume by each deflector, in order to ensure that no air remains outside the food cooking volume at the front of the oven. The radius of curvature at least in part determines the extent to which the path of the air is deflected by the deflector. A deflector with a smaller radius of curvature may be able to deflect more air than a deflector with a larger radius of curvature and/or may be able to change the direction of the air to a greater extent. Hence, using a smaller radius of curvature for the deflectors at the front of the oven may help to ensure that more air at the front of the oven is deflected into the food cooking volume.

BRIEF DESCRIPTION OF THE DRAWINGS

Certain examples of the present disclosure will now be described with reference to the accompanying drawings in which.

DETAILED DESCRIPTION

Figure 1B:
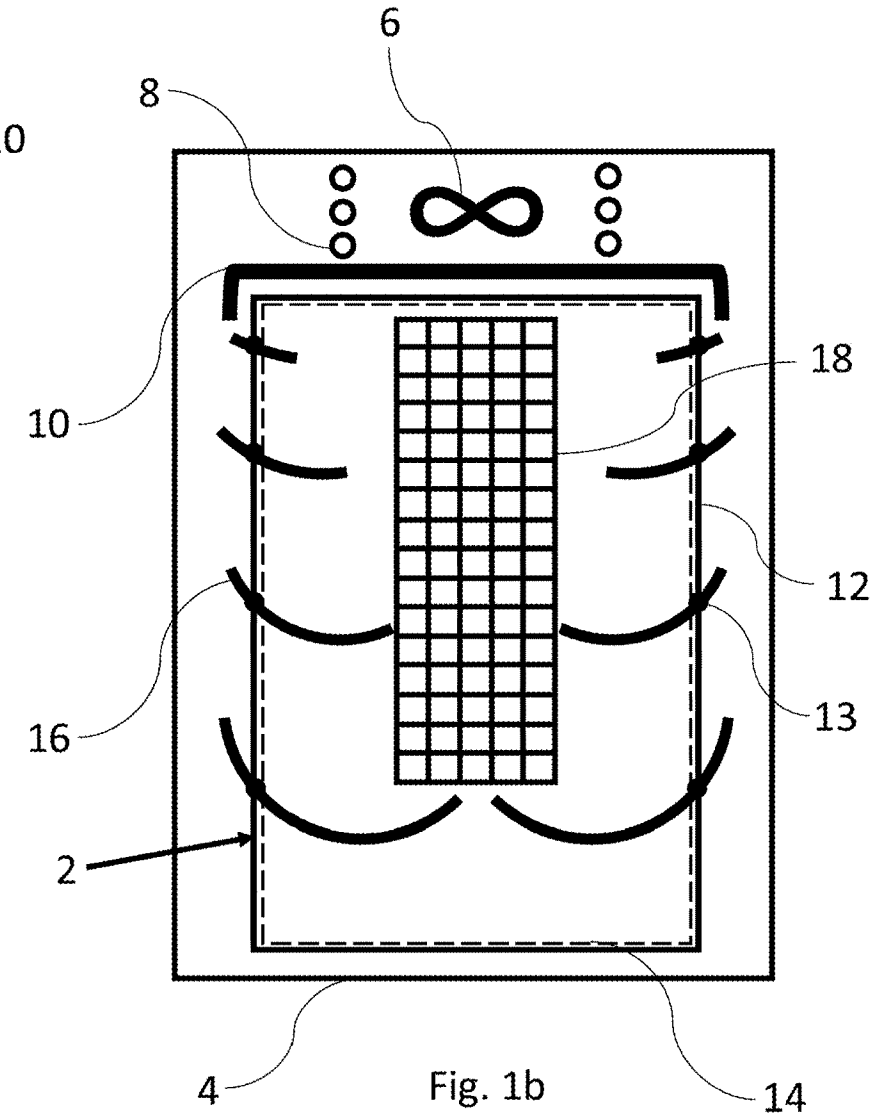
FIGS. 1*a* and 1*b* are schematic cross-sectional top views of an insert inside an oven in accordance with an example of the present disclosure.
Figure 1A:
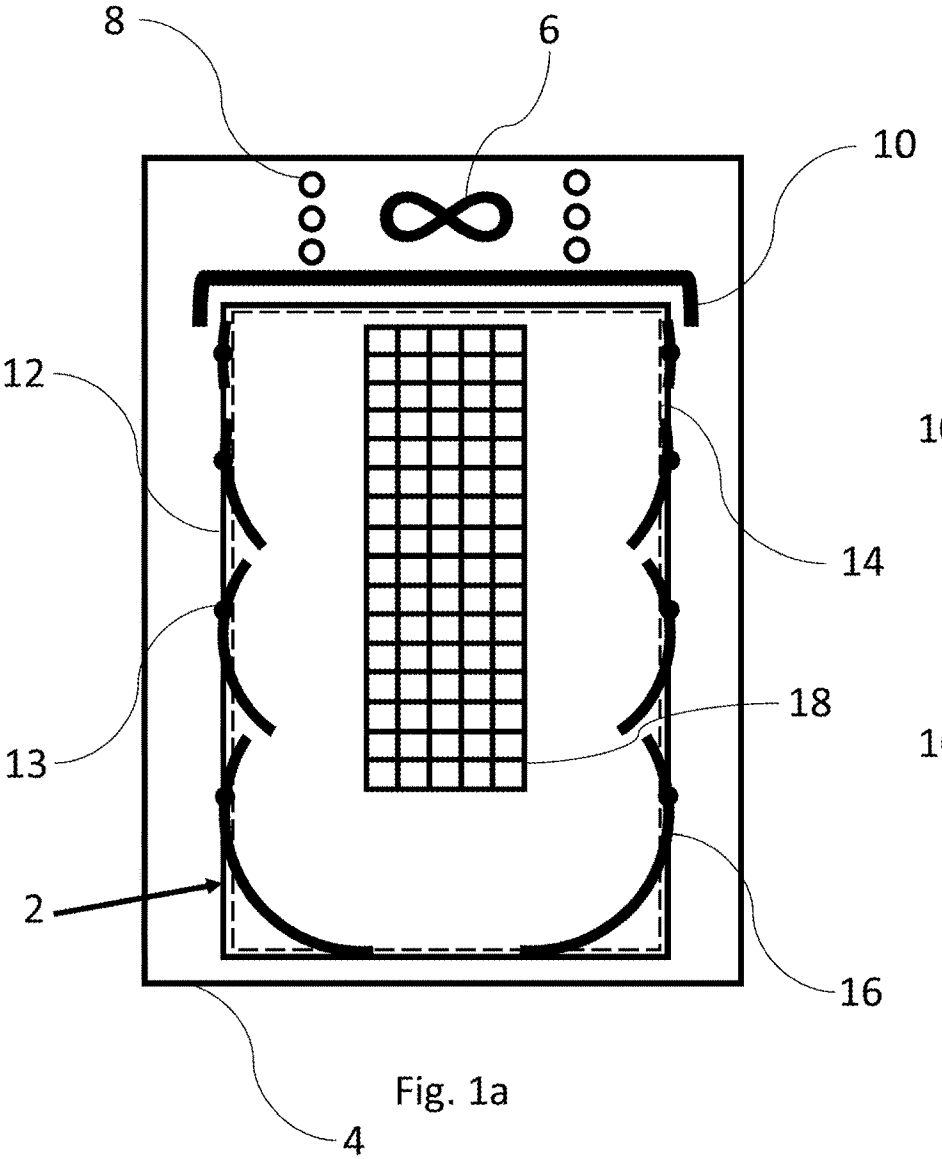

FIGS. 1*a* and 1*b* are schematic cross-sectional top views of an insert 2 inside an oven 4 according to an example of the present disclosure.

In the examples of FIGS. 1*a* and 1*b*, the oven 4 includes a fan 6 and a heating element 8 at the back of the oven 4. The fan 6 moves air over the heating element 8 to increase the temperature of the air and induce circulation of the air around the oven 4. The oven 4 may comprise a convection oven or a steam oven.

The oven 4 further includes a barrier 10, which diverts the air away from the fan 6 and heating element 8 and induces air circulation around the edges of the oven 4. Therefore, in an oven 4 without an insert 2, air travels initially around the edges of the oven 4 from the back of the oven 4 to the front of the oven 4, owing to the presence of the barrier 10. This may result in a significant reduction in the heat and speed of the air, as energy can be lost to the edges of the oven 4. The heat distribution may be improved when one or more of the features described herein are used.

An insert 2 is shown inside the oven 4. The insert 2 includes a housing 12. The inside of the housing 12 defines a food cooking volume 14. Food may be placed anywhere inside the food cooking volume 14 in order to be cooked during operation of the oven 4.

The insert 2 also includes a plurality of deflectors 16 movably mounted on the housing 12. The plurality of deflectors 16 are configured to be actuated from a first position to a second position. The deflectors 16 are shown in the first position in FIG. 1*a* and in the second position in FIG. 1*b*. The deflectors 16 may be mounted on the housing 12 and actuated from the first position to the second position in any suitable and desired manner. In this example, the deflectors 16 are mounted to the housing 12 by an axle 13 and rotated between the first position and the second position.

The plurality of deflectors 16 are configured to deflect air towards the food cooking volume 14 when the plurality of deflectors 16 are in the second position during operation of the oven 4. When the deflectors 16 are in the second position, the housing 12 is at least partially open (e.g. the housing 12 comprises apertures, openings, or at least one open side) to allow air to enter the food cooking volume 14. Air that is circulating around the edges of the oven 4 will be redirected by the ends of the deflectors 16 because they protrude outwardly from the housing 12 when the deflectors 16 are in the second position. The air is then guided towards the center of the food cooking volume 14 by the deflectors 16.

This has the effect of increasing the speed of the air in the food cooking volume 14 and the volume of air passing over the food compared to an oven 4 without an insert 2. This allows food to be cooked more quickly and helps to achieve the result of crispy food with a smaller amount of oil being required in the cooking process.

In the example of FIGS. 1*a* and 1*b*, the deflectors 16 vary in shape and size along the sides of the housing 12. The radius of curvature decreases and the length of the deflectors 16 increases from the back to the front of the oven 4. This helps to ensure that an increasing proportion of the air is redirected into the food cooking volume 14 as the air travels from the back to the front of the oven 4 (i.e. as the air travels further away from the fan 6 and heating element 8). However, the deflectors 16 may be arranged in any suitable and desired manner.

In the example of FIGS. 1*a* and 1*b*, the deflectors 16 are arranged in a symmetrical manner along two of the faces of the housing 12 (i.e. the two sides of the housing 12 comprise deflectors 16 of the same shape and size at the same distance from the back of the oven 4). However, the deflectors 16 may be arranged in any suitable and desired manner.

The insert 2 of FIGS. 1*a* and 1*b* also includes a receptacle for holding food 18 (e.g. a tray or a basket). In the example of FIGS. 1*a* and 1*b*, the receptacle 18 has a meshed structure. The mesh structure defines a plurality of apertures, which allows the air circulating inside the oven 4 to reach the food held inside the receptacle 18 in order to facilitate cooking of the food. However, the receptacle for holding food 18 may be any suitable and desired type.

Figure 2:
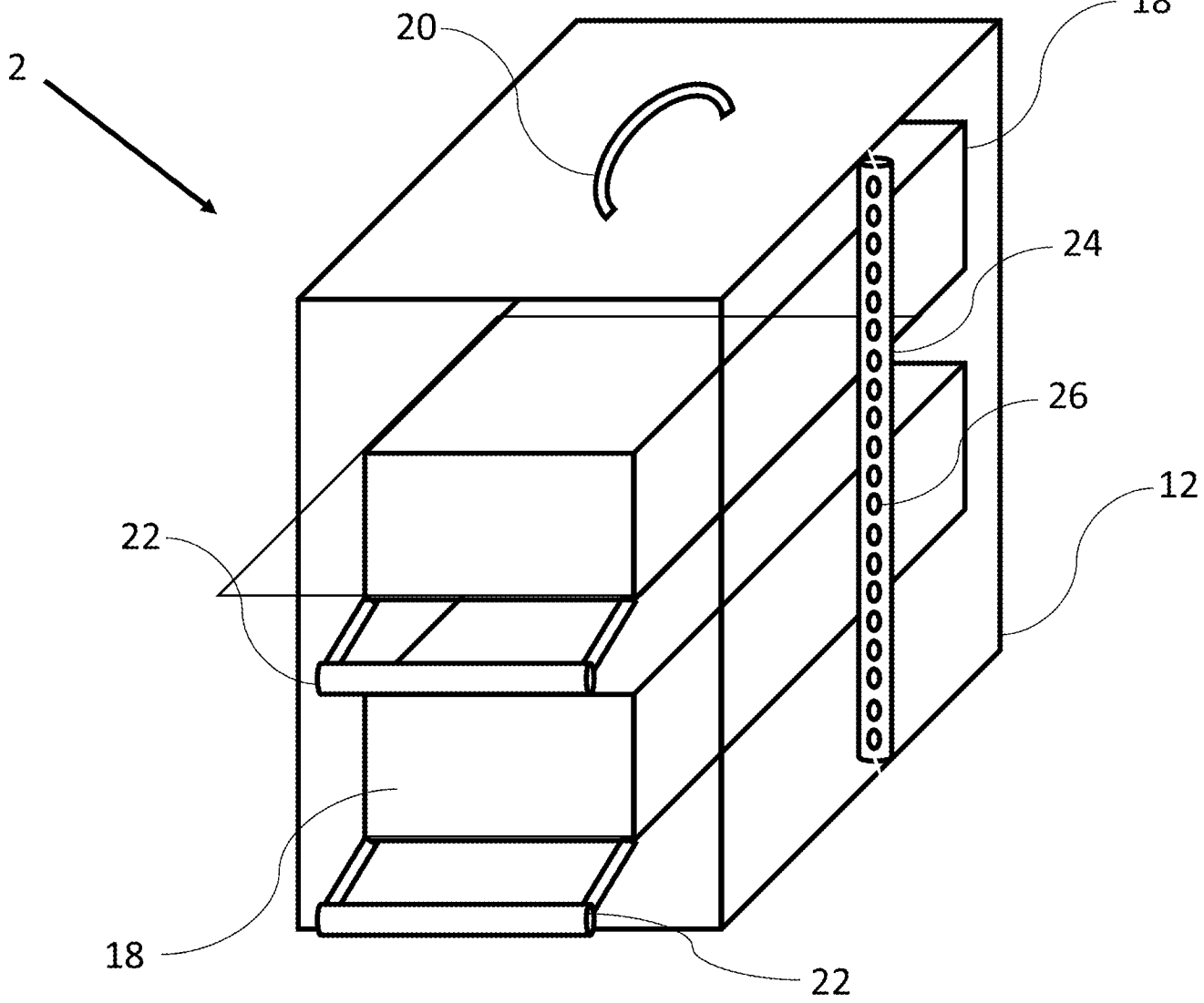
FIG. 2 is a schematic perspective view of an insert in accordance with an example of the present disclosure.

FIG. 2 is a schematic perspective view of an insert 2 according to an example of the present disclosure.

The insert 2 includes a housing 12, which in this example includes a handle 20 for carrying the insert 2. In this example, two receptacles for holding food 18 are shown inside the insert 2. The receptacles 18 may include a handle 22 to facilitate insertion and removal of the respective receptacle 18 from the insert 2. The housing 12 may include an opening (e.g. a door, e.g. in the front of the housing 12) through which a receptacle 18 may be inserted into and removed from the insert 2.

The receptacles 18 may be arranged inside the insert 2 in any suitable and desired manner. In the example of FIG. 2, the receptacles 18 are in a stacked configuration, with a first receptacle situated above a second receptacle.

The insert 2 in FIG. 2 also includes a receptacle for oil 24. The receptacle for oil 24 may take any suitable and desired form. In this example, the receptacle for oil 24 is substantially vertical and has substantially the same vertical extent as the insert 2. The receptacle for oil 24 may be removably situated inside the housing 12 (e.g. so that it may be removed in order to fill the receptacle 24 with oil).

In this example, the receptacle 24 includes a plurality of perforations 26. The perforations 26 allow oil contained in the receptacle 24 to be removed from the receptacle 24 by air circulating inside the oven 4 during operation of the oven 4. At least some of the oil may then be carried into the food cooking volume 14 by the circulating air, in order to at least partially coat the food during cooking.

Figure 3:
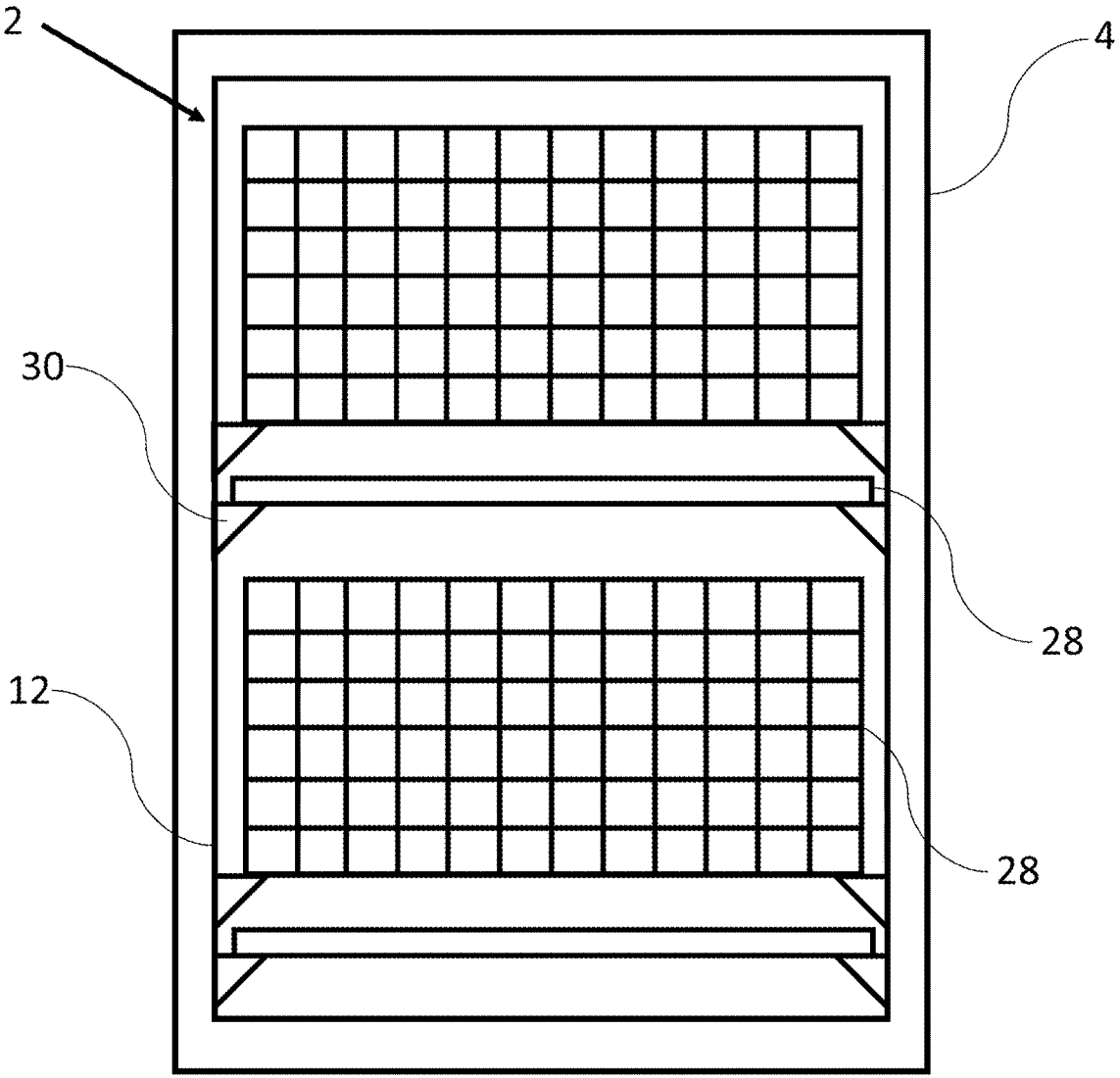
FIG. 3 is a schematic cross-sectional front view of an insert inside an oven in accordance with an example of the present disclosure.

FIG. 3 is a schematic cross-sectional front view of an insert 2 inside an oven 4 according to an example of the present disclosure.

Two receptacles for holding food 18 are shown inside the insert 2. The receptacles 18 may be arranged inside the insert 2 in any suitable and desired manner. In the example of FIG. 2, the receptacles 18 are in a stacked configuration, with a first receptacle situated above a second receptacle.

The insert 2 also includes two drip trays 28. The drip trays 28 may be any suitable and desired type. In this example, the drip trays 28 are situated below each of the two receptacles for holding food 18. The drip trays 28 may help to catch any falling crumbs or oil from the receptacles 18. This may reduce the risk of cross-contamination if different types of food are cooked in each of the receptacles 18. It may also prevent crumbs and oil from coming into contact with the interior surfaces of the oven 4. This may decrease the risk of excess smoke and/or smell coming from the oven 4, as crumbs and oil on the interior surfaces of the oven 4 may become burnt during operation of the oven 4 (e.g. when the oven is not cleaned between cooking cycles).

In the example of FIG. 3, the receptacles for holding food 18 and the drip trays 28 are removably mounted in the housing 12. In this example, the receptacles 18 and drip trays 28 rest on mounts 30, such that they can be slidably mounted in the housing 12. However, any suitable and desired mechanism may be used to removably mount the receptacles 18 and drip trays 28 in the housing 12.

Figure 4:
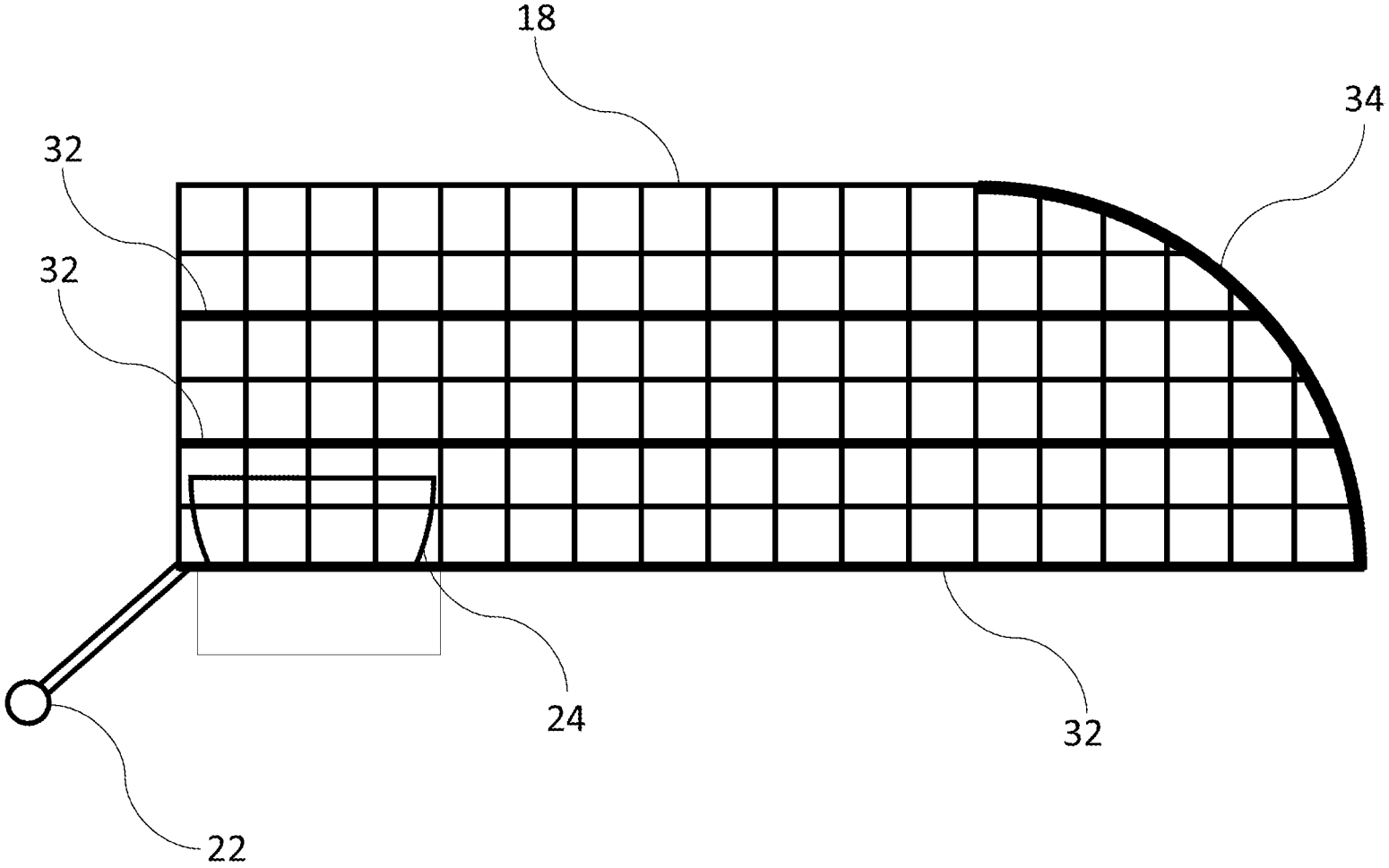
FIG. 4 is a schematic side view of a receptacle for holding food for an insert in accordance with an example of the present disclosure.

FIG. 4 is a schematic side view of a receptacle for holding food 18 for an insert 2 according to an example of the present disclosure.

The receptacle 18 of FIG. 4 includes a plurality of surfaces for holding food 32. The surfaces 32 may be vertically separated from each other to allow food to be placed on each surface 32 of the receptacle 18. The surfaces 32 may have any suitable and desired shape. For example, they may be substantially flat and horizontal as shown in this example, or they may include at least one recess suitable for holding food inside.

The receptacle 18 of FIG. 4 includes a substantially closed surface 34. The substantially closed surface 34 is configured to be proximate to the back of the insert 2 when the receptacle 18 is inside the insert 2. The substantially closed surface 34 may help in deflecting air into the food cooking volume 14 when the oven 4 is in use, by deflecting any air travelling in a direction from the front to the back of the oven 4. In this example, the substantially closed surface 34 is sloped, which may help to direct air downwards towards the food held inside the receptacle 18.

The receptacle for holding food 18 of FIG. 4 includes a receptacle for oil 24. In this example, the receptacle for holding oil 24 is a small bowl which rests on the bottom surface of the receptacle for holding food 18. The receptacle for holding food 18 of FIG. 4 also includes a handle 22, to facilitate insertion and removal of the receptacle for holding food 18 from the insert 2.

Figure 5:
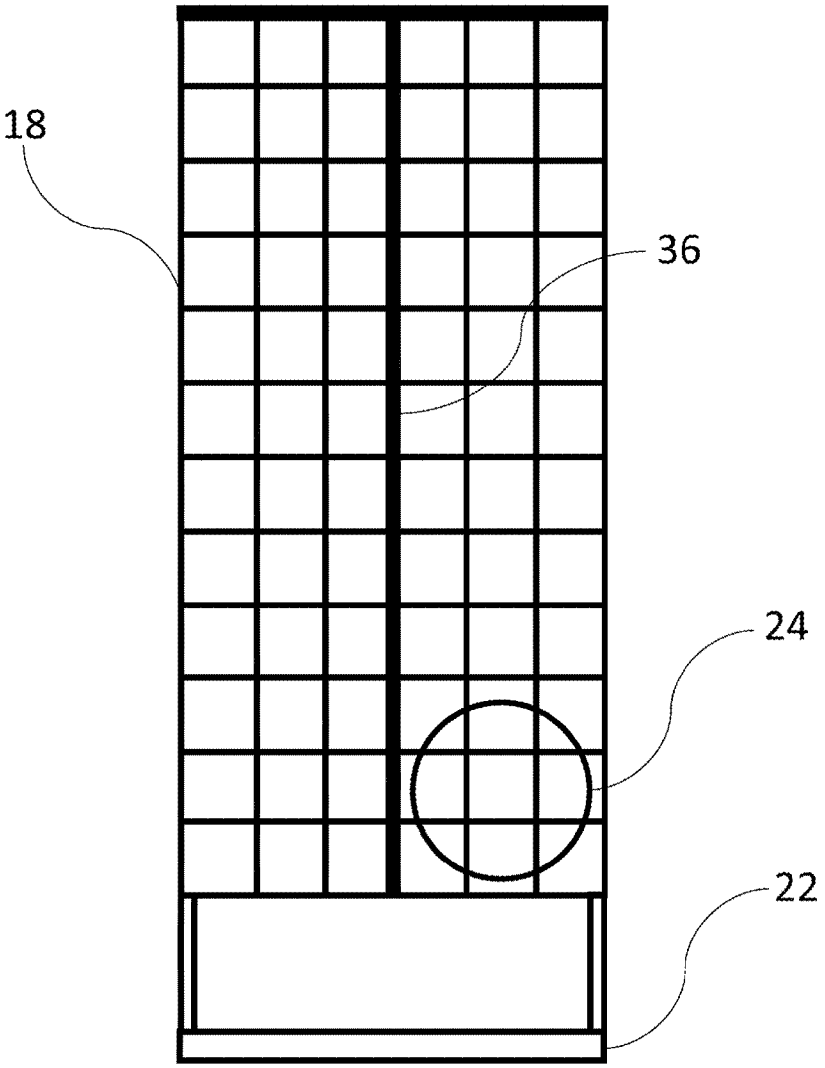
FIG. 5 is a schematic top view of a receptacle for holding food for an insert in accordance with an example of the present disclosure.

FIG. 5 is a schematic top view of a receptacle for holding food 18 for an insert 2 according to an example of the present disclosure.

The receptacle 18 of FIG. 5 includes a divider 36 that extends in a direction between the front side and the rear side of the receptacle 18. In this example, the divider 36 extends from the front side to the rear side of the receptacle 18, in a direction substantially perpendicular to the front and rear sides of the receptacle 18. However, it will be understood that any suitable and desired divider may be used.

The divider 36 may help to reduce the turbulence of the air flow inside the oven 4. For example, air circulating from two sides (e.g. left and right sides) of the oven 4 may be substantially separated by the divider 36 of this example, and therefore do not combine and create turbulence. This may help to maintain higher air speed inside the oven 4.

Figure 6:
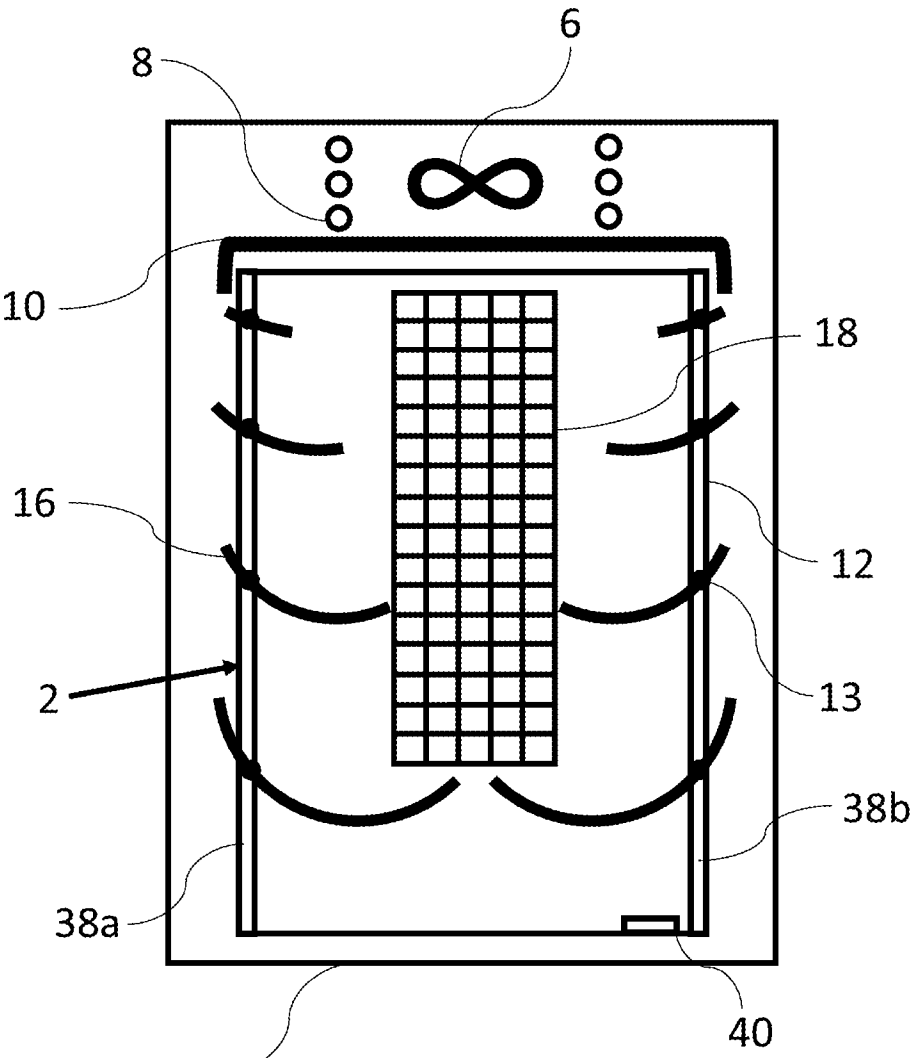
FIG. 6 is a schematic cross-sectional top view of an insert inside an oven in accordance with an example of the present disclosure.

FIG. 6 is a schematic cross-sectional top view of an insert 2 inside an oven 4 in accordance with an example of the present disclosure. In this example, the insert 2 comprises a pair of rods 38*a*, 38*b*. In this example, the rods 38*a*, 38*b* are located on opposite sides faces of the housing 12. Each of the rods 38*a*, 38*b* is connected to a plurality of deflectors 16. The rods 38*a*, 38*b* may be used to help actuate the deflectors 16 from the first position to the second position.

In the example of FIG. 6, the insert 2 also comprises an electrical contact 40. The electrical contact 40 may be placed anywhere on or inside the housing 12, but in this example it is placed proximal to the front of the oven 4 when the insert 2 is inside the oven 4. In some examples, there may be a corresponding electrical contact on or inside the oven 4. The electrical contact(s) 40 may be used to help actuate the deflectors 16 from the first position to the second position.

In many ovens, air inside the oven is heated by a heating element at the back of the oven. Some ovens may comprise a plate proximal to the back of the oven, which prevents air passing directly over the food. This may help prevent the food from coming into contact with extremely hot air and potentially burning. However, a significant proportion of the air then travels around the sides of the oven. As the air travels, it loses energy (i.e. speed and heat) to the sides of the oven. In some applications, it is desirable to reduce the energy lost in this manner, for example in applications where higher temperatures are required to produce crispy food, and/or where a shorter cooking time is desired. A way to achieve this objective is to reduce the distance that the air travels along the sides of the oven during the cooking process.

It will be seen from the above that in some examples, the deflectors of the present disclosure help to achieve this aim by redirecting air away from the edges of the oven and into the center of the oven (i.e. the food cooking volume). The deflectors may achieve this aim by extending outwardly from the insert toward the edges of the oven during operation of the oven (i.e. when the deflectors are in the second position). The deflectors also point inwards towards the center of the food cooking volume. Therefore, when air travelling along the sides of the oven comes into contact with a deflector, at least some of the air is deflected along the deflector towards the food cooking volume.

This may help to increase the speed of the air circulating around the oven and increase the volume of the air that passes the food during cooking. This may help to achieve shorter cooking times than an oven without an insert. It may also help to produce crispy food, with a smaller amount of oil being required to heat the food to the required temperature. Therefore, the present disclosure may help to reduce the amount of fat in the cooked food.

What is claimed is:

1. An insert for an oven, comprising:
a housing;
a food cooking volume inside the housing; and
a plurality of deflectors movably mounted on the housing,
wherein the plurality of deflectors are configured to be actuated from a first position to a second position,
wherein the plurality of deflectors are configured to deflect air towards the food cooking volume responsive to the plurality of deflectors being in the second position during operation of the oven,
wherein the plurality of deflectors are rotatably mounted on the housing; and
wherein each deflector in the plurality of deflectors has a curved cross-section in a plane perpendicular to an axis of rotation of the deflector.

2. The insert for an oven as claimed in claim 1, further comprising:
at least one receptacle for holding food,
wherein the at least one receptacle for holding food is removably mounted in the housing; and
wherein the at least one receptacle for holding food comprises a plurality of apertures.

3. The insert for an oven as claimed in claim 2,
wherein the housing comprises a front face and a rear face opposite the front face;
wherein the at least one receptacle for holding food comprises a rear side arranged to be proximal to the rear face of the insert; and
the at least one receptacle for holding food comprises a substantially closed surface at the rear side.

4. The insert for an oven as claimed in claim 3,
wherein the at least one receptacle comprises a front side opposite the rear side; and
wherein the at least one receptacle for holding food comprises a substantially vertical divider that extends in a direction between the front side and the rear side of the at least one receptacle.

5. The insert for an oven as claimed in claim 1, further comprising:
at least one receptacle for holding oil, wherein the at least one receptacle for holding oil is perforated.

6. The insert for an oven as claimed in claim 1, wherein the plurality of deflectors are configured to be mechanically actuated from the first position to the second position.

7. The insert for an oven as claimed in claim 6, wherein the plurality of deflectors are configured to be actuated responsive to a door of the oven closing.

8. The insert for an oven as claimed in claim 6, wherein the plurality of deflectors are configured to be actuated responsive to the insert being inserted into the oven.

9. The insert for an oven as claimed in claim 6, wherein the plurality of deflectors are configured to be actuated responsive to at least one receptacle for holding food being mounted in the insert and the insert being inside the oven.

10. The insert for an oven as claimed in claim 9,
wherein the insert comprises a rod,
wherein the plurality of deflectors are connected to the rod, and
wherein the plurality of deflectors are configured to be actuated by the rod responsive to:
a door of the oven closing;
the insert being inserted into the oven; or
the at least one receptacle for holding food being mounted in the insert and the insert being inside the oven.

11. The insert for an oven as claimed in claim 1, wherein the plurality of deflectors are configured to be electrically actuated from the first position to the second position.

12. An insert for an oven, comprising:
a housing;
a food cooking volume inside the housing; and
a plurality of deflectors movably mounted on the housing,
wherein the plurality of deflectors are configured to be actuated from a first position to a second position,
wherein the plurality of deflectors are configured to deflect air towards the food cooking volume responsive to the plurality of deflectors being in the second position during operation of the oven,
wherein the plurality of deflectors are configured to be mechanically actuated from the first position to the second position, and
wherein the plurality of deflectors are configured to be actuated by air circulating inside the oven during operation of the oven.

13. An insert for an oven, comprising:
a housing;
a food cooking volume inside the housing; and
a plurality of deflectors movably mounted on the housing,
wherein the plurality of deflectors are configured to be actuated from a first position to a second position,
wherein the plurality of deflectors are configured to deflect air towards the food cooking volume responsive to the plurality of deflectors being in the second position during operation of the oven,
wherein the plurality of deflectors are configured to be electrically actuated from the first position to the second position,
wherein the insert comprises an electrical contact,
wherein the plurality of deflectors are connected to the electrical contact, and
wherein the plurality of deflectors are configured to be actuated by the electrical contact responsive to:
a door of the oven closing;
the insert being inserted into the oven;
the oven being switched on; or
at least one receptacle for holding food being mounted in the insert and the insert being inside the oven.

* * * * *